US010806281B2

(12) United States Patent
Robertson

(10) Patent No.: US 10,806,281 B2
(45) Date of Patent: Oct. 20, 2020

(54) SUBSTRATE HAVING A THERAPEUTIC TACTILE OBJECT ATTACHED

(71) Applicant: Madeline J. Robertson, Norman, OK (US)

(72) Inventor: Madeline J. Robertson, Norman, OK (US)

( * ) Notice: Subject to any disclaimer, the term of this patent is extended or adjusted under 35 U.S.C. 154(b) by 0 days.

(21) Appl. No.: 16/569,538

(22) Filed: Sep. 12, 2019

(65) Prior Publication Data

US 2020/0000257 A1 Jan. 2, 2020

Related U.S. Application Data

(63) Continuation of application No. 15/593,136, filed on May 11, 2017, now abandoned.

(60) Provisional application No. 62/374,312, filed on Aug. 12, 2016, provisional application No. 62/334,777, filed on May 11, 2016.

(51) Int. Cl.
*A47G 9/10* (2006.01)
*A47G 9/02* (2006.01)

(52) U.S. Cl.
CPC ..... *A47G 9/1045* (2013.01); *A47G 9/0253* (2013.01)

(58) Field of Classification Search
CPC ..... A47G 9/1045; A47G 9/0253
See application file for complete search history.

(56) References Cited

U.S. PATENT DOCUMENTS 2,961,668 A * 11/1960 Hayes ..... A47D 15/008 5/640
3,789,546 A * 2/1974 Morrison ..... A47G 9/1045 446/327
4,197,604 A * 4/1980 Nakamura ..... A47G 9/1045 446/72
4,309,784 A * 1/1982 Cohen ..... A47G 9/0253 5/639
4,538,310 A * 9/1985 Scott ..... A47D 15/006 5/633
4,790,042 A * 12/1988 Reich ..... A47D 13/08 5/421
4,853,994 A * 8/1989 Ekstein ..... A47G 9/1045 5/639
4,914,765 A * 4/1990 Smith ..... A47G 9/1045 401/201
4,959,879 A * 10/1990 Marxhausen ..... A47G 9/0253 446/73
5,027,457 A * 7/1991 Sweet ..... A47G 9/0253 428/100

(Continued)

*Primary Examiner* — Robert G Santos
*Assistant Examiner* — Rahib T Zaman
(74) *Attorney, Agent, or Firm* — Lamon Patent Services; Cynthia S. Lamon

(57) ABSTRACT

A substrate is provided having a tactile object attached, the substrate constructed of a first material forming a shell. The tactile object may be formed of a second material that is different than the first material, the tactile object formed in the shape of a comfort item. The tactile object further has a first side providing tactile sensory feedback, and a second side configured to be attached to the shell such that the first side of the tactile object extends away from the first rectangular side of the shell. According to the inventive concepts disclosed herein, the substrate is provided to a user in need of comfort and the tactile object provides tactile sensory feedback to the user designed to comfort the user.

7 Claims, 5 Drawing Sheets

(56) References Cited

U.S. PATENT DOCUMENTS 5,168,590 A * 12/1992 O'Sullivan ..... A47G 9/0253 5/421
5,184,362 A * 2/1993 Yager ..... A47G 9/0253 446/72
5,367,731 A * 11/1994 O'Sullivan ..... A47G 9/0253 5/645
5,534,014 A * 7/1996 Demeritt ..... A61J 17/007 606/234
5,581,833 A * 12/1996 Zenoff ..... A47C 7/546 108/43
5,584,086 A * 12/1996 VanWinkle ..... A47C 20/021 5/490
5,898,962 A * 5/1999 McNeal ..... A47G 9/1045 40/661
6,038,720 A * 3/2000 Matthews ..... A47C 7/383 5/636
6,267,638 B1 * 7/2001 Connolly ..... A47G 9/0253 446/227
6,560,802 B2 * 5/2003 Fujii ..... A47G 9/1045 368/10
6,810,545 B1 * 11/2004 Darling ..... A47D 13/08 5/630
6,951,035 B2 * 10/2005 Kinchen ..... A47C 16/04 5/420
7,089,617 B1 * 8/2006 Lauro ..... A47G 9/0253 5/490
7,380,298 B2 * 6/2008 Hernandez ..... A47G 9/1045 5/639
7,464,424 B1 * 12/2008 Formica ..... A47D 13/08 5/655
7,722,357 B2 * 5/2010 Payette-Hebert .... A47G 9/0253 434/236
8,007,044 B1 * 8/2011 Dubey ..... A47C 7/383 297/392
8,127,382 B1 * 3/2012 Plascencia ..... A47G 9/1045 5/490
8,615,830 B2 * 12/2013 McQuoid ..... A47G 9/1045 5/636
8,695,137 B1 * 4/2014 Hanson ..... A47D 15/006 128/869
9,009,889 B1 * 4/2015 Cohen ..... A47G 9/0253 5/482
2002/0020019 A1 * 2/2002 Koenig ..... A47D 15/00 5/636
2002/0095725 A1 * 7/2002 Dix ..... A47D 15/00 5/482
2008/0218369 A1 * 9/2008 Krans ..... A47G 9/1045 340/691.1
2008/0289109 A1 * 11/2008 Jackson ..... A47D 13/08 5/632
2010/0024130 A1 * 2/2010 Moore ..... A47G 9/0253 5/636
2010/0145167 A1 * 6/2010 Im ..... A47G 9/1045 600/301
2012/0278994 A1 * 11/2012 Bonzer ..... A47D 13/083 5/655
2013/0091632 A1 * 4/2013 Roban ..... A47G 9/1081 5/639
2014/0018609 A1 * 1/2014 Howard ..... A61M 21/02 600/28
2014/0345055 A1 * 11/2014 Li ..... A47G 9/1027 5/630
2015/0135442 A1 * 5/2015 Deane ..... A47G 9/10 5/636
2016/0302589 A1 * 10/2016 Peterson ..... A47D 13/083

* cited by examiner

SUBSTRATE HAVING A THERAPEUTIC TACTILE OBJECT ATTACHED

INCORPORATION BY REFERENCE

This application is a continuation of U.S. application Ser. No. 15/593,136, filed May 11, 2017, titled SUBSTRATE HAVING A THERAPEUTIC TACTILE OBJECT ATTACHED AND METHODS OF USING SAME, which claims benefit under 35 U.S.C. 119(e) of U.S. Provisional Patent Application Ser. No. 62/334,777, filed May 11, 2016 and 62/374,312 filed Aug. 12, 2016, both of which are expressly incorporated herein by reference.

BACKGROUND OF THE INVENTION

Conventional pillows, pillowcases, sheets, clothing, and other fabric-based items, are well known in the art. The conventional pillow and pillowcase, for example, are generally rectangular in shape. The pillow serves as a support for the head during rest and sleep, and is usually made of soft foam, feathers or other natural or synthetic material which provides a comfortable support surface for the head. The pillowcase itself is usually made of cloth and serves as a cover for receiving the pillow, wherein the cover protects the pillow from becoming dirty and soiled, and may be removed from the pillow to allow for easy cleaning. Hence, when the pillowcase becomes soiled, it is removed from the pillow and cleaned while the pillow remains substantially free from dirt.

The average person spends generally about 8 hours per day in a bed sleeping or relaxing. Persons who are institutionalized, such as in a hospital or long term care facility, may spend even more time in a bed resting, sleeping or otherwise recuperating. In such instances, the person may be frightened or apprehensive and in need of comfort. In such an instance, the presence of a close acquaintance or family member may have a comforting or calming effect on the person. However, such a close acquaintance or family member may not be available when needed by the patient.

In some cases, the patient may have suffered a neurological injury or an injury causing the loss of sight or hearing. Of the five senses, people rely most on sight and sound to function in their daily lives. Historically, when the sense of sight and/or sound was lost or significantly damaged, the victim was considered disabled because, until recently, scientists believed brain and neurological damage to be irreversible. However, scientists now believe that the brain has greater plasticity (the ability to modify its own structures creating new pathways to compensate for injury) than was previously thought. To compensate for damaged capacities, such as the loss of sight or hearing, the brain, it is now believed, can be retrained to build new pathways. One potential tool for such sensory and other brain regeneration could be through use of comforting and familiar touchable objects.

Existing hospital financial incentives, risks of nosocomial infections, and the potential for other hospital-based iatrogenic injuries put pressure on physicians to discharge patients from hospitals as soon as possible. However, discharging patients before they are sufficiently healthy, or before necessary arrangements for home care and follow-up outpatient care have been made, has contributed to unplanned hospital re-admissions. Unfortunately, the incentives to discharge patients as soon as possible have not lessened, hence the extraordinarily high readmission rates.

Adding to the problem, home health care, at this time, is not covered by most insurance as long as a person is still legally qualified to drive. However, when a person is sick or otherwise injured they may not physically be able to drive. Thus there are patients for whom home health care may be medically necessary but financially unavailable.

Because home health care is not provided, the patient is required to travel for follow-up appointments to receive necessary care. When a patient is unable to drive themselves, in the past, neighbors, friends, or family members have provided assistance with rides or other necessities. Today, however, neighbors may not even be acquainted with each other let alone willing to provide assistance. Consequently, there are patients who are not able to keep follow-up appointments because of the lack of transportation.

What is needed then is a substrate, such as a pillow case, shirt, overcoat, blanket, sheet, or other fabric-based item, for example, having a tactile object attached thereto which serves as a comfortable and useful conventional item, for example a pillow case, and also as a therapeutic object and/or physical reminder for a person. It is to such a substrate having a tactile object attached thereto that the inventive concepts are disclosed herein.

BRIEF DESCRIPTION OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale, or in schematic in the interest of clarity and conciseness. Not every component may be labeled in every drawing. Like reference numerals in the figures may represent and refer to the same or similar element or function. In the drawings.

DETAILED DESCRIPTION OF THE PREFERRED EMBODIMENT

Figure 1:
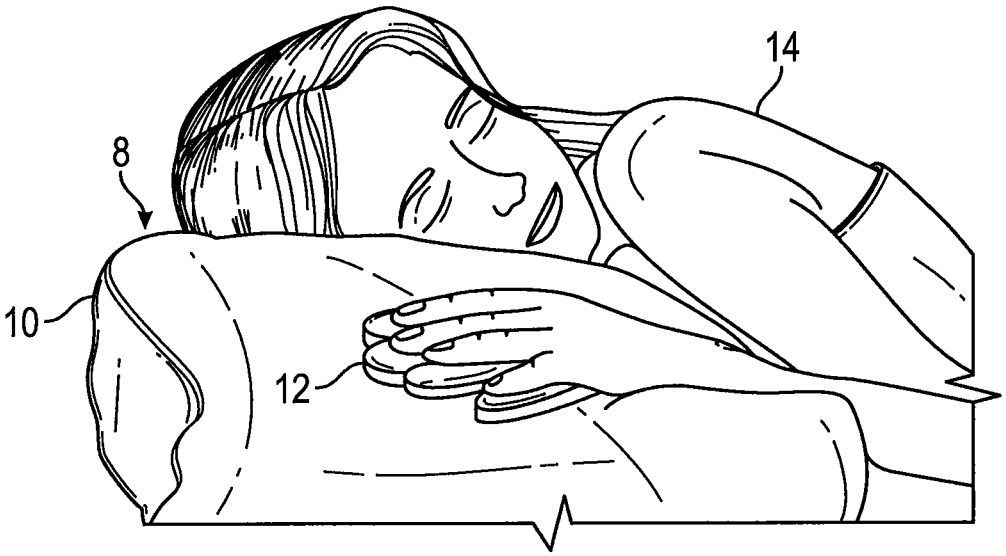
FIG. 1 is a perspective view of a person lying on a pillowcase having a tactile object attached in accordance with one embodiment of the inventive concepts disclosed herein.

Before explaining at least one embodiment of the disclosure in detail, it is to be understood that the disclosure is not limited in its application to the details of construction, experiments, exemplary data, and/or the arrangement of the components set forth in the following description or illustrated in the drawings unless otherwise noted.

The systems and methods as described in the present disclosure are capable of other embodiments or of being practiced or carried out in various ways. Also, it is to be understood that the phraseology and terminology employed herein is for purposes of description, and should not be regarded as limiting.

The following detailed description refers to the accompanying drawings. The same reference numbers in different drawings may identify the same or similar elements.

As used in the description herein, the terms "comprises," "comprising," "includes," "including," "has," "having," or any other variations thereof, are intended to cover a non-exclusive inclusion. For example, unless otherwise noted, a process, method, article, or apparatus that comprises a list of elements is not necessarily limited to only those elements, but may also include other elements not expressly listed or inherent to such process, method, article, or apparatus.

Further, unless expressly stated to the contrary, "or" refers to an inclusive and not to an exclusive "or". For example, a condition A or B is satisfied by one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or more, and the singular also includes the plural unless it is obvious that it is meant otherwise. Further, use of the term "plurality" is meant to convey "more than one" unless expressly stated to the contrary.

As used herein, any reference to "one embodiment," "an embodiment," "some embodiments," "one example," "for example," or "an example" means that a particular element, feature, structure or characteristic described in connection with the embodiment is included in at least one embodiment. The appearance of the phrase "in some embodiments" or "one example" in various places in the specification is not necessarily all referring to the same embodiment, for example.

Referring now to the figures, and in particular to FIG. 1, shown therein is a substrate 8 comprising, more specifically, a pillowcase 10 having a tactile object 12 attached thereto. In some embodiments of the presently claimed and/or disclosed inventive concept(s), the tactile object 12 attached to the pillowcase 10 may be therapeutic for a person 14.

Figure 2:
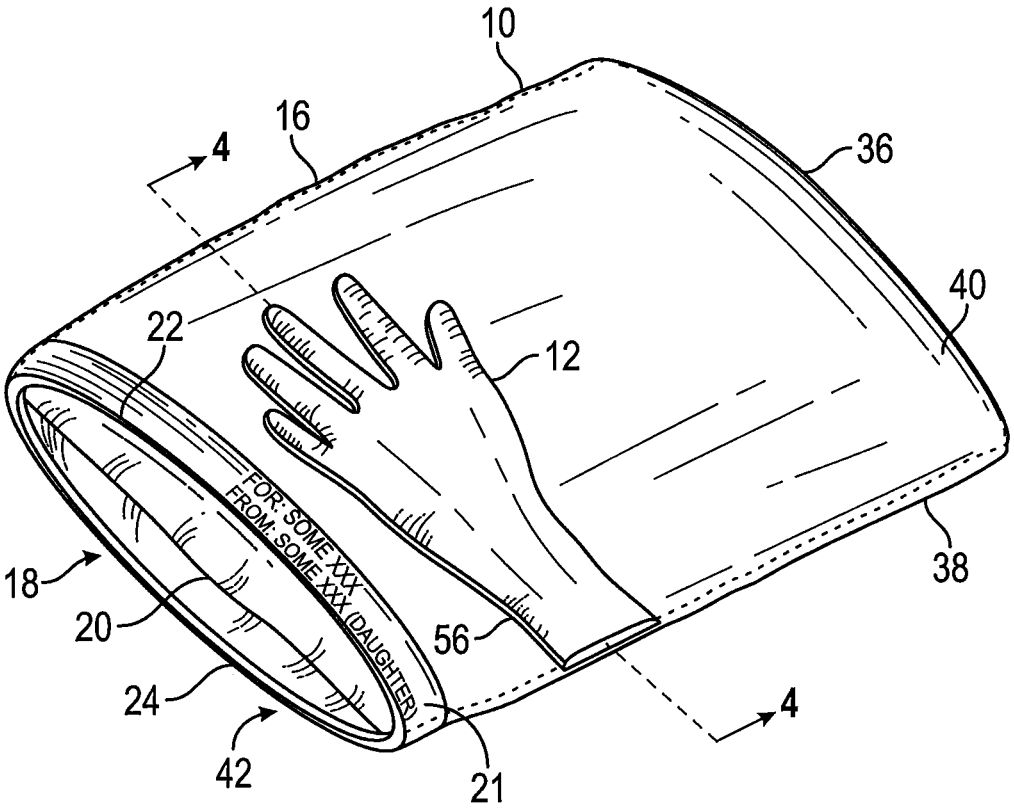
FIG. 2 is a perspective view of a pillowcase having a tactile object attached in accordance with one embodiment of the inventive concepts disclosed herein.
Figure 3:
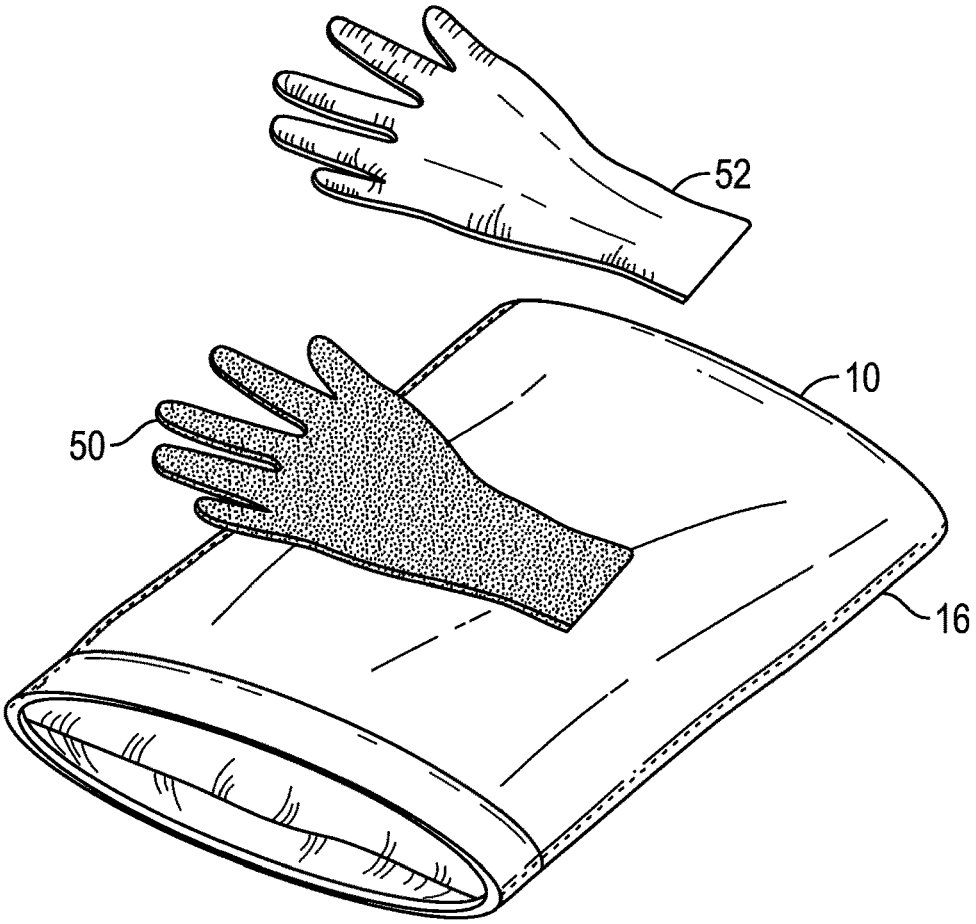
FIG. 3 is an exploded perspective view of the tactile object as well as the pillowcase of FIG. 2.
Figure 4:
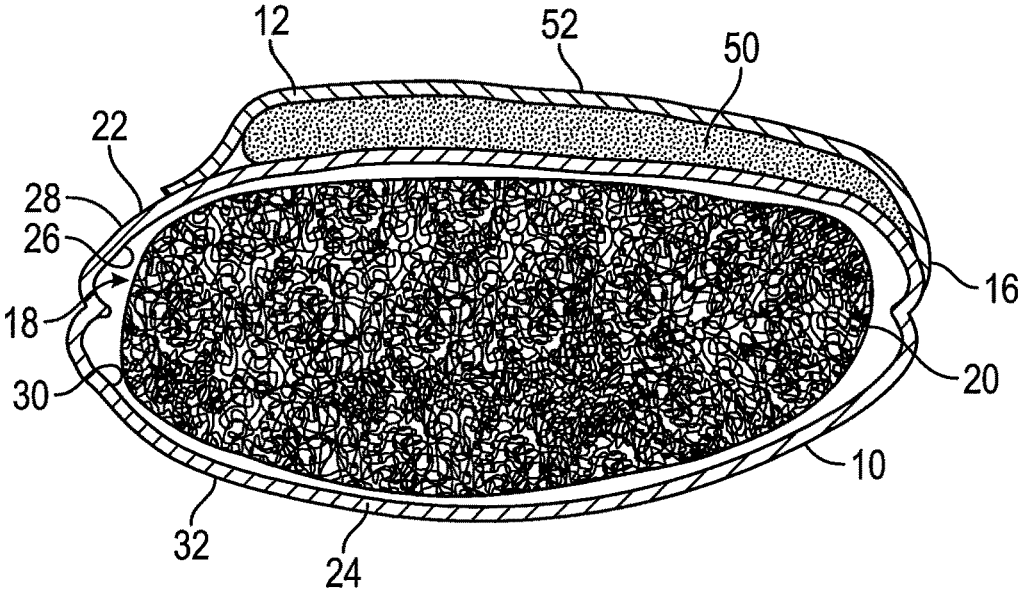
FIG. 4 is a cross-sectional side view of one embodiment of the pillowcase having a tactile object attached taken along the line 4-4 of FIG. 2.

Referring now to FIGS. 2-4, the pillowcase 10 is provided with a shell 16 formed of a material such as, for instance, cotton fabric which forms a cavity 18 which may at least partially surround a pillow 20. Although the shell 16 is described as being formed of cotton fabric, it will be appreciated that the shell 16 may be constructed or formed from any material suitable for use by a user as a pillowcase or other supporting apparatus that is in close contact with the face of the user. In one embodiment, the pillowcase 10 may be provided with indicia 21 that is indicative of the owner of the pillowcase 10 and/or indicative of the owner and/or model of the tactile object 12. The indicia 21 may be, for example, the name and address of the model for the tactile object 12. The indicia 21 may be, alternatively, the name and address of the owner of the pillowcase 10. It should be appreciated that the indicia 21 can be any type of information and may, in at least one embodiment, be indicative of the relationship between the person 14 and the model for the tactile object 12. The inventor contemplates that the indicia 21 will: (a) help patients with dementia remember who gave them their pillowcase 10; (b) ensure that the pillowcase 10 stays with the person 14 and, if lost, make its way back to person 14; and (c) serve as a conversation piece to thereby increase social interactions for the person 14 who may be suffering from social isolation.

As best shown in FIG. 3, the shell 16 of the pillowcase 10 has a first sheet 22 and a second sheet 24. The first sheet 22 has an inner surface 26 and an outer surface 28, while the second sheet 24 has an inner surface 30 and an outer surface 32. The inner surface 26 of the first sheet 22 and inner surface 26 of the second sheet 24 defines the cavity 18 for receiving a pillow 20. By way of a non-limiting example, as shown in FIG. 2 the first sheet 22 and second sheet 24 are rectangular in shape and are approximately 30" long by approximately 18" wide.

Turning to FIGS. 2 and 4, the first sheet 22 and second sheet 24 are joined along their perimeters at sides 34, 36 and 38 by sewn stitches 40. This defines the cavity 18 for receiving the pillow 20 through an opening 42. It should be noted that the first sheet 22 and second sheet 24 can be made of a single piece of fabric folded along any of sides 34, 36 or 38 and joined at the two remaining sides by sewn stitches or other conventional joining means such that the cavity 18 is formed for receiving the pillow 20 through opening 42. It should also be noted that opening 42 may be at least temporarily closed by closing means such as, for instance, a zipper, buttons, overlapping portions of materials, and/or snaps.

Tactile object 12 may, in one embodiment, comprise a flat sheet of material that has been sewn or otherwise applied to the outer surface 28 of the first sheet 22. The tactile object 12 may be any natural or synthetic type of material. In another embodiment, the tactile object 12 may be printed onto the outer surface 28.

In yet a further embodiment, as shown in FIGS. 3 and 4, the tactile object 12 may be provided with a three-dimensional form or structure by placing an amount of stuffing 50 between the outer surface 28 of the first sheet 22 and a tactile shell 52. In this manner, the tactile object 12 is given the three-dimensional look and feel. Stuffing 50 may be any natural or synthetic type of stuffing or batting as known in the art.

A shape of the tactile shell 52 may be created from a three-dimensional object (not shown) such as a person's hand or face, or it could be formed in the shape of a character or design. Indeed, the tactile shell 52 may be formed in any shape which may bring a sense of comfort to the user, such as person 14. For example, but not by way of limitation, the tactile shell 52 may be in the shape of a cross for a follower of the Christian faith. Alternatively, the tactile shell 52 may be in the shape of a Star of David for a follower of the Jewish faith. Similarly, the tactile shell 52 may be in the shape of a tree for a user that is comforted by the outdoors. Any shape of a character or design which brings the user a sense of comfort may be used for the tactile shell 52.

In the embodiment shown, the three-dimensional object is a person's hand which is outlined just beyond its outermost periphery such that an outline of the person's hand forms an outline of the tactile shell 52. The tactile shell 52 is joined to outside surface 28 of first sheet 22 by sewn stitches 56 (FIG. 2) along the outermost perimeter of tactile shell 52. When the stuffing 50 is placed between the tactile shell 52 and the first sheet 22, the tactile object 12 embodies the three-dimensional contours of the person's hand. It should be noted that the tactile shell 52 may be joined to first sheet 22 by other conventional joining means and in any orientation relative to the shell 16 which may be desired.

Figure 5:
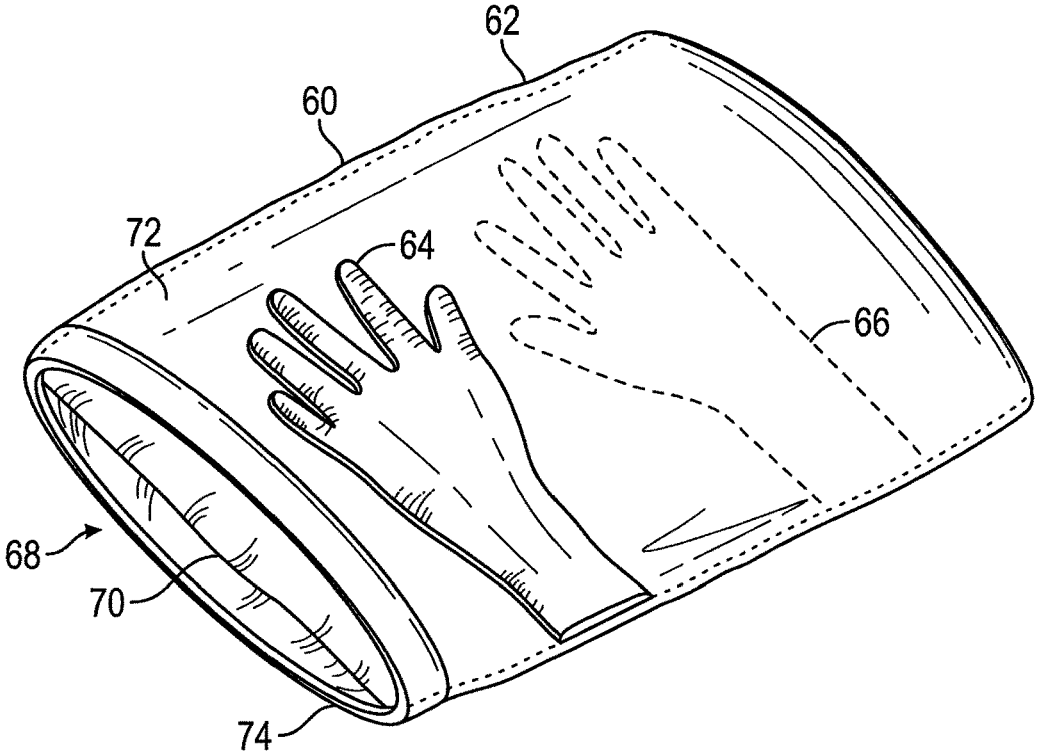
FIG. 5 is a perspective view of a pillowcase having a first tactile object attached to a first side and a second tactile object attached to a second side opposite the first side in accordance with one embodiment of the inventive concepts disclosed herein.

Referring now to FIG. 5, in another embodiment, a pillow case 60 is provided having a shell 62, a first tactile object 64, a second tactile object 66, a cavity 68, and a pillow 70. Pillow case 60 is formed essentially the same as the pillowcase 10, therefore, in the interest of brevity, only the new features of pillow case 60 will be described herein.

In the embodiment shown in FIG. 5, the first tactile object 64 is attached to a first sheet 72 and the second tactile object 66 is attached to a second sheet 74 opposite the first sheet 72. In this way, regardless of which of the first or second sheets 72 or 74 is placed in a configuration substantially adjacent the user, one of the first or second tactile objects 64 or 66 will also be facing and outward direction.

Figure 6:
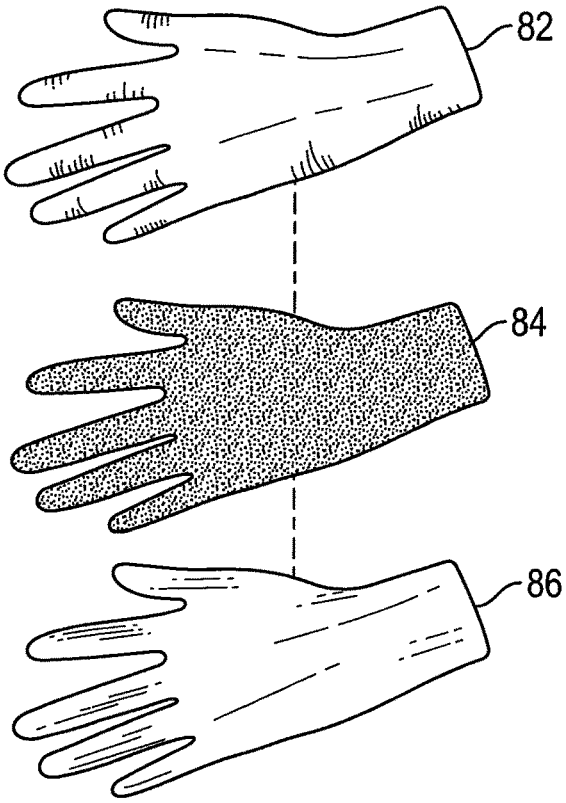
FIG. 6 is an exploded perspective view of a removable tactile object in accordance with one embodiment of the inventive concepts disclosed herein.
Figure 7:
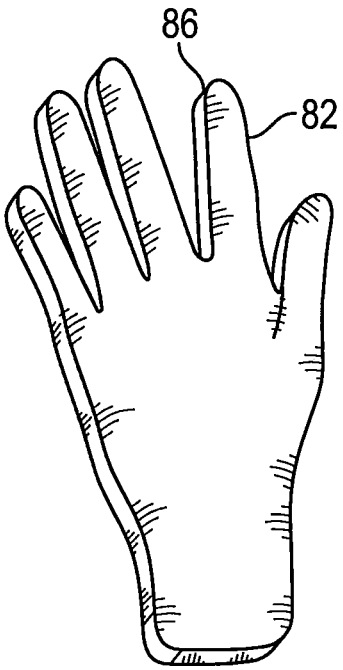
FIG. 7 is a perspective view of a front side of the removable tactile object of FIG. 6.
Figure 8:
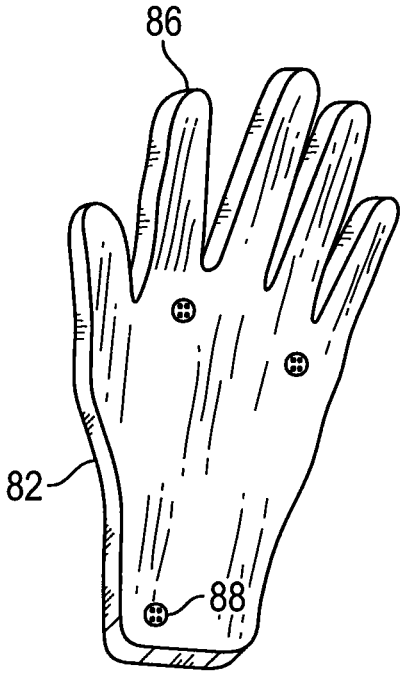
FIG. 8 is a perspective view of a back side of the removable tactile object of FIG. 6.

Referring now to FIGS. 6-8, shown therein is one embodiment of a tactile object 80 having a tactile shell 82, stuffing 84, and a backing shell 86. In the embodiment shown, tactile shell 82 and backing shell 86 envelope and completely enclose the stuffing 84 to form the tactile object 80. The tactile object 80 may also be provided having fastening means 88 (only one of which is designated in FIG. 8) configured to allow the tactile object 80 to be removeably fastened to a pillowcase (not shown) similar to pillowcases 10 and 60 described above. The fastening means 88 may be, for instance, buttons, magnets, hook and loop fasteners, or other fastening means known in the art. Such an embodiment would allow the tactile object 80 to be removed from the pillowcase when, for instance, the pillowcase needed to be cleaned. In addition, such an embodiment would also allow the tactile object 80 to be fastened to a plurality of different pillowcases such as, for instance, in an institutional setting (e.g. a hospital or long-term care facility) where bedding is provided by the facility and the person may not always receive the same bedding. In such a case, a plurality of pillowcases may be provided by the facility each having fastening means which correspond to fastening means 88 on the tactile object 80.

It should be noted that although the pillow cases 10 and 60 have been described herein as having a rectangular shape and being made of cotton fabric, it should be noted that pillow cases 10 or 60 could be provided in various shapes and sizes such as a square, triangle or circle and be made of various natural and/or synthetic types of materials and blends, including "smart fabrics" that can collect data about the user and transmit that data in real time to a remote location (e.g. a Provider's office or a loved one's smart phone). For example, patients recently discharged from hospitals are particularly vulnerable to pneumonia. Conventionally, health care professionals rely on the discharged patient themselves to collect and present data about their current condition (e.g. the patient must make the effort to find a thermometer, take their temperature, read the results correctly, then call their doctor to report a temperature reading above a certain predefined threshold, for example at or above 100.4 degrees Fahrenheit). On the other hand, a patient supplied with a pillowcase 10 having at least part of the shell 16 constructed of smart fabric which is able to measure a core temperature of the patient must only put their head on the pillowcase 10 and the pillowcase 10 is able to automatically take a temperature reading. Because the temperature reading is taken automatically, and the pillowcase 10 is already where the patient is likely to go, for instance, when they are feeling ill or just feel the need to rest, i.e. bed, it is more likely that an accurate and timely temperature reading will be taken which will more likely result in timely and appropriate medical intervention. Treating patients with temperatures exceeding the predefined level with targeted antibiotic treatments in a timely manner, as well as not over-treating patients who subjectively report feeling "feverish" but who may not actually have a fever, has benefits both to the patient and the public, particularly given the dwindling utility of existing antibiotic that has occurred as a consequence of their overuse. It should be noted that, generally, fevers spike in the evening and at night when the patient will naturally be in bed with their head on their pillow where the pillowcase 10 is able to automatically take a temperature reading. In such an embodiment, the pillowcase 10 may be configured to automatically take a temperature reading when the presence of the patient is sensed using, for instance, a pressure sensor or other appropriate sensing means. In another embodiment, the pillowcase 10 may be configured to automatically take a temperature reading at predetermined intervals, or at predetermined times. It should be noted, however, that these examples are provided for the sake of illustration and are not meant as to limit the presently disclosed inventive concepts to any particular means or method of determining when to take a temperature reading. In some embodiments, the temperature reading may be transmitted to a remote location (e.g., a physician's office, a home health provider, a family member, 911 emergency) in real-time or as part of a scheduled transmission.

It should also be noted that although tactile objects 12, 64, 66, and 80 have been described as being formed of layers of material, the tactile objects 12, 64, 66, and 80 may also be formed in other ways such as, for instance, preparing a cast of a desired object then forming the tactile object 12, 64, 66, or 80 as a single piece of material, or scanning the object to create a three-dimensional model and printing the tactile object 12, 64, 66, or 80 using three-dimensional printing technology.

As discussed above, it has been found that the brain has much greater plasticity than previously thought. In a case where a patient has suffered neurological damage or the loss of the sense of sight or hearing, the pillowcase 10 having tactile object 12 attached thereto may serve as a therapeutic tool allowing the patient to feel a comforting or familiar object while stimulating the brain. In accordance with the current disclosure, this brain stimulation using tactile objects such as tactile object 12 that emphasize the sense of touch can help to regenerate damaged parts of the brain.

Figure 9:
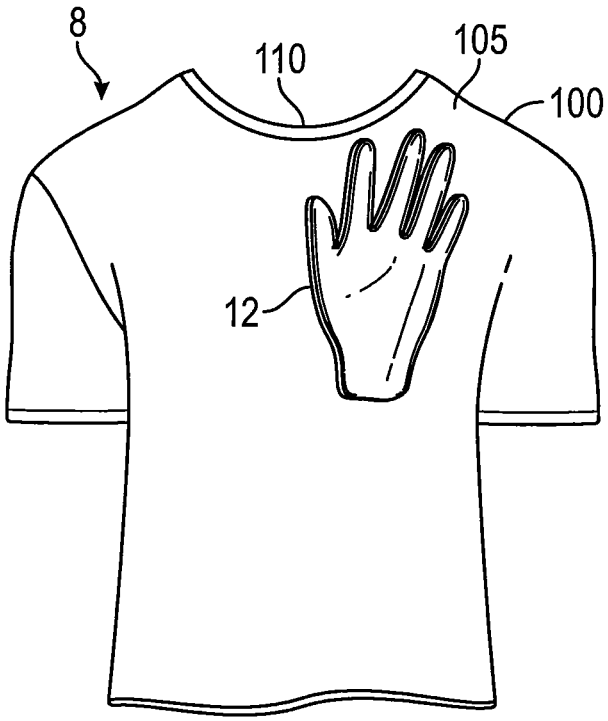
FIG. 9 is a front view of a shirt having a tactile object attached in accordance with one embodiment of the inventive concepts disclosed herein.

In an alternative embodiment of the presently disclosed inventive concept(s) shown in FIG. 9, the substrate 8 comprises a shirt 100 having a tactile object 12 disposed thereon. Although the tactile object 12 is shown as being placed generally on a left shoulder 105 of the shirt 100, it is contemplated that the tactile object 12 can be placed anywhere on the shirt 100 that is convenient for the user. For example, the tactile object 12 may be placed in the general area adjacent the user's belly (not shown). In the case of a child, it may be desirable to place the tactile object 12 closer to a neck 110 of the shirt 100 so that the child may place the tactile object 12 near their face.

Given the above, the substrate 8 having a tactile object 12 provides to a user a sense of comfort and connection to a remote or unavailable loved one or care provider. Communications technology using the senses of sight and sound has greatly increased, thus facilitating and expanding opportunities for long distance communications/relationships; however, such technology omits our human need to touch and be touched. By way of non-limiting example, to offer a level of comfort and connection, a parent leaving town for a week's travel, for instance, may leave behind a substrate 8 having a tactile object 12 in the shape of their hand, thereby providing their child with a soothing and comforting feeling of the parent's presence while gone. Conversely, the parent could take a substrate 8 having a tactile object 12 in the shape of their child's hand with them thereby providing the parent an opportunity to feel close to their child while separated. As another example, a member of the military could take a substrate 8 having a tactile object 12 in the shape of their spouse or child's hand along on their deployment. Finally, within residential or outpatient addiction treatment facilities there is a need for the patient to feel "connected" with their loved ones outside the facility yet still maintain a physical separation. Having a substrate 8 having one or more tactile objects 12 attached thereto representing the patient's loved ones can assist in their overall treatment plan. For example, some addiction facilities prohibit any real-time communication with anyone outside the treatment facility, but allow patients to have photos and/or sound recordings of loved ones. The tactile object 12 would supplement the visual and auditory "connections" provided by the photos and/or sound recordings or loved ones with the tactile object 12.

Although shown as being publicly and/or easily seen, the tactile object 12 may be placed on the substrate 8 in such a manner that the tactile object 12 cannot be seen by third parties. For example, but not by way of limitation, the tactile object 12 may be placed inside a pair of mittens (with the interior lining of the mittens being substrate 8) such that the tactile object 12 can be felt by the user but is not visible to third parties. Alternatively, the tactile object 12 may be sewn to the inside of a coat pocket (with the inner lining of the coat pocket being substrate 8) such that the tactile object 12 can be felt by the user when they place their hand in the pocket but, once again, it is not visible to third parties. In this manner, the tactile object 12 can be used to soothe the user in situations where third party attention is unwanted, ill-advised, or inappropriate.

The presently disclosed inventive concept(s) can also be provided in a kit form (not shown) which may be made available by the hospital, doctor, craft store, or craft educators, for instance. In kit form, the substrate 8 may be provided along with the necessary items to create the tactile object 12. For example, the necessary items to create the tactile object 12 may include a pair of safety scissors, cloth, batting or other fill, markers or other marking devices, patterns or stencils and the like, and instructions for creating the substrate 8 along with the tactile object 12. In this manner, the user or loved ones themselves can make whatever tactile object 12 is desired for the situation and place it on a substrate 8 of their own choosing.

In a case where a patient has recently been discharged from hospital, studies have shown that patient non-compliance with discharge or post-discharge instructions is a key factor leading to hospital readmissions within 30 days of discharge. According to fiscal year 2015 data released by the Centers for Medicare and Medicaid Services (CMS), seventy plus percent of hospitals are being penalized 1-3% of their total Medicare budget ($100,000.00 to $500,000.00 per year) for exceeding CMS limits on readmissions within 30 days of discharge, pursuant to The Hospital Readmissions Reduction Program, a part of the Affordable Care Act. Because the patient is no longer being treated in an inpatient setting, doctors and hospitals have expressed frustration over their lack of control over discharged patients actions that may increase the likelihood of unplanned readmission.

Common non-compliant behaviors of recently discharged patients, especially the elderly and disabled include, but are not limited to: (1) not taking meds as prescribed; (2) not making it to their follow-up outpatient care appointments because they forgot or lacked transportation; (3) not calling their doctors when problems/questions arise (e.g. temperature above 100.4 F is a fever that must be reported immediately to their outpatient doctor); (4) not understanding instructions when discharged and/or misplacing paperwork; (5) confusion consequent to feeling ill; and (6) living alone and lacking sufficient social support to maintain compliance.

Figure 10:
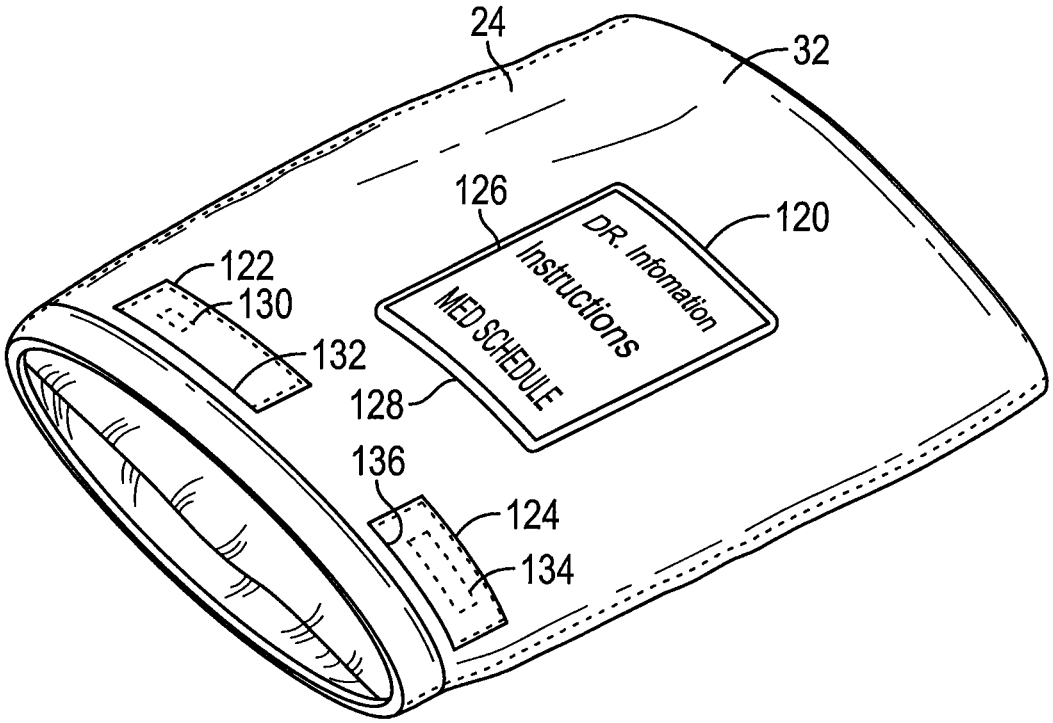
FIG. 10 is a perspective view of a pillowcase having a first pocket, a second pocket, and a third pocket attached in accordance with one embodiment of the inventive concepts disclosed herein.

In accordance with the current disclosure, it has been found that the pillowcase 10 may help some discharged patients address non-compliant behaviors that may lead to hospital readmission. For instance, at discharge, a doctor may provide a patient with the pillowcase 10 having one or more tactile objects 12 representing a hand of the doctor attached thereto. That way, the patient will have a tactile reminder of the doctor and will be able to maintain a connection with the doctor after they have been discharged. As shown in FIG. 10, the pillowcase 10 may be provided having a first pocket 120, a second pocket 122, and a third pocket 124 sewn or otherwise applied to the outer surface 32 of the second sheet 24 of the pillowcase 10.

The first pocket 120 may be secured on three sides to the outer surface 32 of the pillowcase 10 with a fourth side forming an opening 128 which may be configured to allow a communication media 126 to be removeably disposed between the first pocket 120 and the outer surface 32 of the pillowcase 10. The first pocket 120 may be at least partially constructed of a transparent material to allow the user to view the communication media 126 while disposed in the first pocket 120. The opening 128 of the first pocket 120 may be at least temporarily closed by closing means such as, for instance, a zipper, buttons, overlapping portions of materials, and/or snaps to secure the communication media 126 in the first pocket 120.

The communication media 126 may be a piece of paper or other suitable material and may include written or visual communication printed, for instance, or otherwise fixed on a surface thereof. By way of non-limiting example, the communication media 126 may include written or visual communication indicative of the doctor's name and contact information, care instructions from the doctor (otherwise referred to herein as discharge or post-discharge instructions), a list of potential problems/symptoms that the user should report to the doctor if experienced, a log for the patient to make a contemporaneous record of relevant symptoms and medications taken, a date or dates of future important events such as an outpatient appointment with the doctor, and/or a phone number for a transportation service such as, for instance, a Medicaid non-emergency medical transportation service provider or a cab company.

It should be noted that in some cases a patient may receive multiple pages of discharge instructions printed on communication media 126. In such a case, the pillowcase 10 may be provided having more than one (not shown) first pocket 120. Alternately, the first pocket 120 may be provided sized appropriately to allow more than one page of discharge instructions printed on the communication media 126 to be seen by the patient through the transparent portion of the first pocket 120. In any case, it will be appreciated by a person of skill in the art that, in accordance with the present disclosure, the pillowcase 10 may be adapted with any number or size of first pocket 120 to allow the patient to insert and/or see all of their discharge instructions printed on communication media 126.

The second pocket 122 of the pillowcase 10 may be constructed to hold medication 130 thus ensuring that the patient's medication 130 is readily accessible while in bed. The second pocket 122 may be secured on three sides to the outer surface 32 of the pillowcase 10 with a fourth side forming an opening 132 which may be configured to allow the patient to insert the medication 130. To secure the medication 130 in the second pocket 122, the opening 132 of the second pocket 122 may be at least temporarily closed by closing means such as, for instance, a zipper, buttons, overlapping portions of materials, and/or snaps.

In accordance with one embodiment (not shown) of the pillowcase 10, the second pocket 122 may be provided with a plurality of inner sections designed to separate the medication 130 by, for instance, different types of medication 130, time of day the medication 130 should be taken, or days of the week. It should be noted, however, that these examples are provided for the purposes of description only and should not be construed as limiting.

The third pocket 124 may be constructed to hold an alarm 134. The third pocket 124 may be secured on three sides to the outer surface 32 of the pillowcase 10 with a fourth side forming an opening 136 which may be configured to allow the patient to insert the alarm 134. The opening 136 of the second pocket 122 may be at least temporarily closed by closing means such as, for instance, a zipper, buttons, overlapping portions of materials, and/or snaps to secure the alarm 134 in the second pocket 122.

The alarm 134 may be set to go off each time medication 130 must be taken for the 30 days following discharge of the patient and to remind the patient of, for instance, a first scheduled outpatient appointment. The alarm 134 may be provided with an auditory indication such as a recorded or synthesized voice reminder. For instance, the recorded voice reminder may say "it is time to take medication 'A'" to indicate a scheduled time to take medication "A". Many patients leaving the hospital are on multiple medications 130, so the recorded voice reminder could be set to specify which medication 130 the patient is to take at the time of the auditory indication to prevent common medication errors such as taking the wrong pill.

In one embodiment (not shown), the pillowcase 10 may include indicia printed, for instance, on the shell 16 of the pillowcase 10. The indicia may be indicative of key home-care instructions (e.g. call this number if your temperature exceeds 100.4 degrees F.), out-patient care contact information, and/or the number to schedule free transport to an appointment, and may be printed where the indicia is easily visible by the user.

By providing means whereby the patient has a tactile reminder of the connection with their doctor, as well as ready access to discharge and/or post discharge instructions, pertinent contact information, medications, and alarm reminders, it is more likely that the patient will comply with the discharge instructions and post-discharge treatment. Having everything they need to help them stay compliant in one pillowcase 10, which will be with them where they go when they feel the worst, i.e. bed, should reduce the number of patients unnecessarily readmitted within 30 days of discharge.

In addition to improving patient compliance, embodiments of the pillowcase 10 described herein may be used by healthcare providers as marketing devices when they are adapted to add the provider's name, contact information, and/or logo. In such embodiments, the pillowcase 10 has the dual purpose of (1) improving patient compliance as described above; and (2) marketing (e.g. substituting for the current common practice of giving patients free T-shirts as wearable advertisement for the Provider, which have no other functional value.)

From the above description, it is clear that the presently disclosed inventive concept(s) is well adapted to carry out the objects and to attain the advantages mentioned herein as well as those inherent in the invention. While exemplary embodiments of the invention have been described for purposes of this disclosure, it will be understood that numerous changes may be made which will readily suggest themselves to those skilled in the art and which are accomplished within the spirit of the inventive concept disclosed and claimed herein.

What is claimed is:

1. A substrate having a tactile object attached, comprising:

a first material forming a shell for encasing a pillow, the shell having a first rectangular surface and a second rectangular surface, the first rectangular side and the second rectangular side attached along at least three perimeter edges to form a central cavity enabled to accept the pillow, leaving one open end at a width perimeter of the rectangle; and a tactile object formed of a second material that is different than the first material, the tactile object formed as a mirror image of a person's hand configured to be attached to the first rectangular side of the shell;

wherein the tactile object is positioned on one half or less of a first side of the first surface of the first rectangular surface of the substrate and angled such that a user laying their head on a second side of the first rectangular surface of the substrate opposite the first side and placing their hand on the mirror image with the user's fingers substantially aligned with fingers on the tactile object providing tactile sensory feedback to the user designed to comfort the user.

2. The substrate of claim 1, wherein the second surface of the tactile object is removeably attached to the first rectangular side of the shell.

3. The substrate of claim 1, wherein the tactile object is provided constructed of a material that resembles human skin.

4. The substrate of claim 1, wherein the first rectangular side further comprises indicia printed on the first side, the indicia indicative of who provided the substrate to the user.

5. The substrate of claim 1, wherein the second rectangular side further comprises indicia printed on the second side, the indicia indicative of at least one of key home-care instructions, out-patient care contact information, and/or a contact number to schedule free transportation.

6. The substrate of claim 1, wherein the second side of the shell is constructed of the first material and the substrate is further provided with a third material, the first side of the shell constructed of the third material which is a smart material configured to collect data about the user and transmit that data in real time to a remote location.

7. The substrate of claim 1, wherein the substrate is provided to the user to reduce at least one of anxiety and/or depression of the user.

* * * * *